US007427169B2

(12) United States Patent
Ma et al.

(10) Patent No.: US 7,427,169 B2
(45) Date of Patent: Sep. 23, 2008

(54) HAIR TREATMENT FLUID APPLICATION DEVICE

(75) Inventors: Kok Wah Ma, Singapore (SG); Steven Thomas Slot, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 377 days.

(21) Appl. No.: 10/498,768

(22) PCT Filed: Dec. 19, 2002

(86) PCT No.: PCT/IB02/05648

§ 371 (c)(1),
(2), (4) Date: Jun. 15, 2004

(87) PCT Pub. No.: WO03/053188

PCT Pub. Date: Jul. 3, 2003

(65) Prior Publication Data

US 2005/0063914 A1 Mar. 24, 2005

(30) Foreign Application Priority Data

Dec. 20, 2001 (WO) ..... PCT/SG01/00266

(51) Int. Cl.
*B43K 5/04* (2006.01)
*A45D 24/22* (2006.01)

(52) U.S. Cl. ..... 401/157; 401/152; 401/155; 132/113; 132/114

(58) Field of Classification Search ..... 401/156, 401/157, 152–155, 158–169; 132/112–116
See application file for complete search history.

(56) References Cited

U.S. PATENT DOCUMENTS

| | | | | |
|---|---|---|---|---|
| 4,098,434 | A | 7/1978 | Uhlig | |
| 5,332,121 | A | 7/1994 | Schmidt et al. | |
| 5,913,314 | A | 6/1999 | Garrett | |
| 6,145,513 | A * | 11/2000 | Chu et al. | 132/112 |
| 6,334,449 | B1 * | 1/2002 | Burrowes et al. | 132/114 |

FOREIGN PATENT DOCUMENTS

| | | |
|---|---|---|
| CH | 118931 | 2/1927 |
| WO | 9926510 | 6/1999 |
| WO | 0049905 | 8/2000 |
| WO | 03053188 | 7/2003 |

* cited by examiner

*Primary Examiner*—David J Walczak

(57) ABSTRACT

A hair treatment fluid application device includes a flexible container for containing a hair treatment fluid, an applicator body having outlet orifices for applying the hair treatment fluid to hair, the flexible container having a passage opening for allowing egress of the hair treatment fluid from the flexible container to the applicator body, a housing for accommodating the flexible container, an air pump for exerting pressure on the flexible container for forcing the hair treatment fluid from the flexible container through the passage opening to the applicator body by deforming the flexible container and a driver for driving the pressure means.

15 Claims, 3 Drawing Sheets

HAIR TREATMENT FLUID APPLICATION DEVICE

Figure 1:
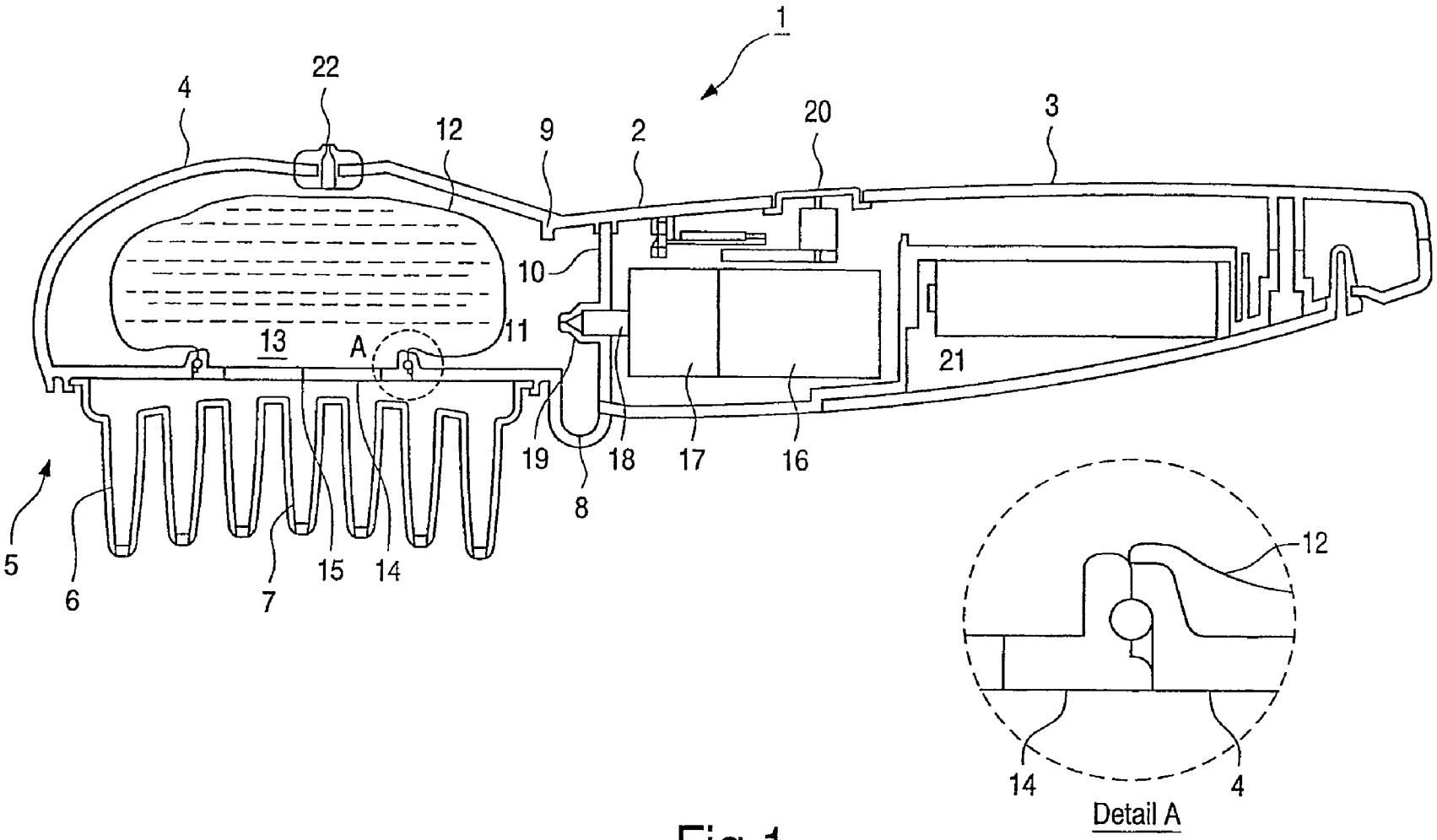

The invention relates to a hair treatment fluid application device comprising a flexible container for containing said hair treatment fluid, an applicator body having outlet orifices for applying said hair treatment fluid to hair, said flexible container having a passage opening for allowing egress of said hair treatment fluid from said flexible container to said applicator body, and a housing for accommodating said flexible container.

Such a device is known from WO-A1-99/26510. In this document a hair coloring kit is described which makes use of a flexible bag which Is inserted into a bottle made from a resiliently deformable plastics material. A support tube is Inserted into the bag through an opening thereof By using an insert, which surrounds the tube at the position of the opening of the bag, the bag is attached to the bottle such that fluid material can only be transported into or out of the bag through the tube. On top of the insert a valve member and a spout can be attached. The spout leads to a brush/comb-like applicator. Typically, the flexible bag is already filled with a first material, such as hydrogen peroxide. A second material is added to this first material through the tube after the bag has been inserted into the bottle. In order to apply this mixed material to hair, the bottle is squeezed by the user, causing a compression of air within the bottle and collapsing of the bag such that the mixing fluid is forced out through the tube and through the valve member which prevents suck-back of fluid into the bag. The bottle is squeezed repeatedly by the user with whatever pressure and frequency Is deemed appropriate to the circumstances.

WO-A2-00/49905 describes several embodiments of a hair dye applicator. These embodiments have in common that they make use of a collapsible fluid container which basically has the shape of a bag. This container is placed within an air container having an open outer end. At the side of this open outer end, the fluid container is attached to the air container with the open side of the fluid container also being located at the open outer end of the air container. The applicator additionally comprises a hollow brush cover which is attachable to the air container. In the attached state the inner volume of the brush cover is in communication with the inner volume of the fluid container. The space between the outside of the fluid container and the inside of the air container is hermetically sealed. Through a valve system, however, air may be supplied to the space in order to increase the pressure and to collapse the fluid container for pressing the contents of the fluid container towards the brush cover.

All above described devices are rather cumbersome to operate by a user, especially when this user is not really familiar with this operation and uses such a device, for example, for the first time. In practice this means that spillage of fluids is likely to occur, all the more since the application of the fluids to the hair usually takes place when the head is awkwardly positioned. The user who applies such fluids to his/her own hair does not have full sight of this application and may easily apply (locally) too much fluid to the hair.

It is the object of the present invention to provide a solution or improvements regarding the above mentioned drawbacks of the devices according to the state of the art. To achieve this, the device according to the invention comprises pressure means for exerting pressure on said flexible container for forcing said hair treatment fluid from said flexible container through said passage opening to said applicator body by deforming said flexible container, and comprises driving means for driving said pressure means.

The use of such pressure means renders possible a very well controlled application of hair treatment fluid to hair without the need of any manual operation. The pressure means are preferably located within the housing in order to attain a very compact construction.

The spillage of fluid can be advantageously prevented if the passage opening is embodied by a one-way valve member. Such a valve member does not allow the passage of the contents of hair treatment fluid within the flexible container through its opening unless the pressure which is being exerted upon this valve member by this fluid exceeds a certain threshold value. Such a one-way valve member also prevents the backflow of hair treatment fluid to the container.

Such a backflow is also prevented when alternatively the housing is provided with a one-way valve member for hair treatment fluid which has issued through the passage opening. In such a construction, the one way valve member is not a disposable article that can be used for different containers.

One advantageous embodiment of the pressure means is provided when the pressure means comprise an air pump for increasing the air pressure within at least part of the housing. The use of such an air pump reduces the need of mechanical moving parts within the housing.

In order to prevent the occurrence of too high pressures within the housing, the housing is preferably provided with vent means for releasing air from the housing as soon as the air pressure within the housing exceeds a certain threshold value.

A very advantageous alternative embodiment of the pressure means is obtained if the pressure means comprise moving means for moving a pressure body against the flexible container. The moving pressure body deforms the flexible container, thus decreasing its inner volume and forcing its contents out of the flexible container. Such a pressure body may be a piston for which preferably the housing acts as a cylinder. A very simple construction may be obtained in this way.

Alternatively, the pressure body may be a roller element which is rotatable about an axis extending perpendicularly to the direction of movement. Such a roller element may very efficiently squeeze out all the fluid contents from the flexible container.

A very simple construction is provided if in operation the roller element squeezes said flexible container against an inner surface of the housing.

According to a very advantageous embodiment, the application device is provided with reset means for returning the pressure body to an initial position. Due to such reset means, the pressure body such as a piston or a roller element can be returned when the contents have been fully squeezed out, or at any time before the full consumption of the contents. In that case a switch is to be provided which may be operated, for example, manually or automatically when the pressure body passes a certain point. Upon activation of this switch, the moving means, for example an electric motor of which the connection terminals are interchanged, will change direction, thus bringing back the piston or roller to its initial position.

Figure 2:
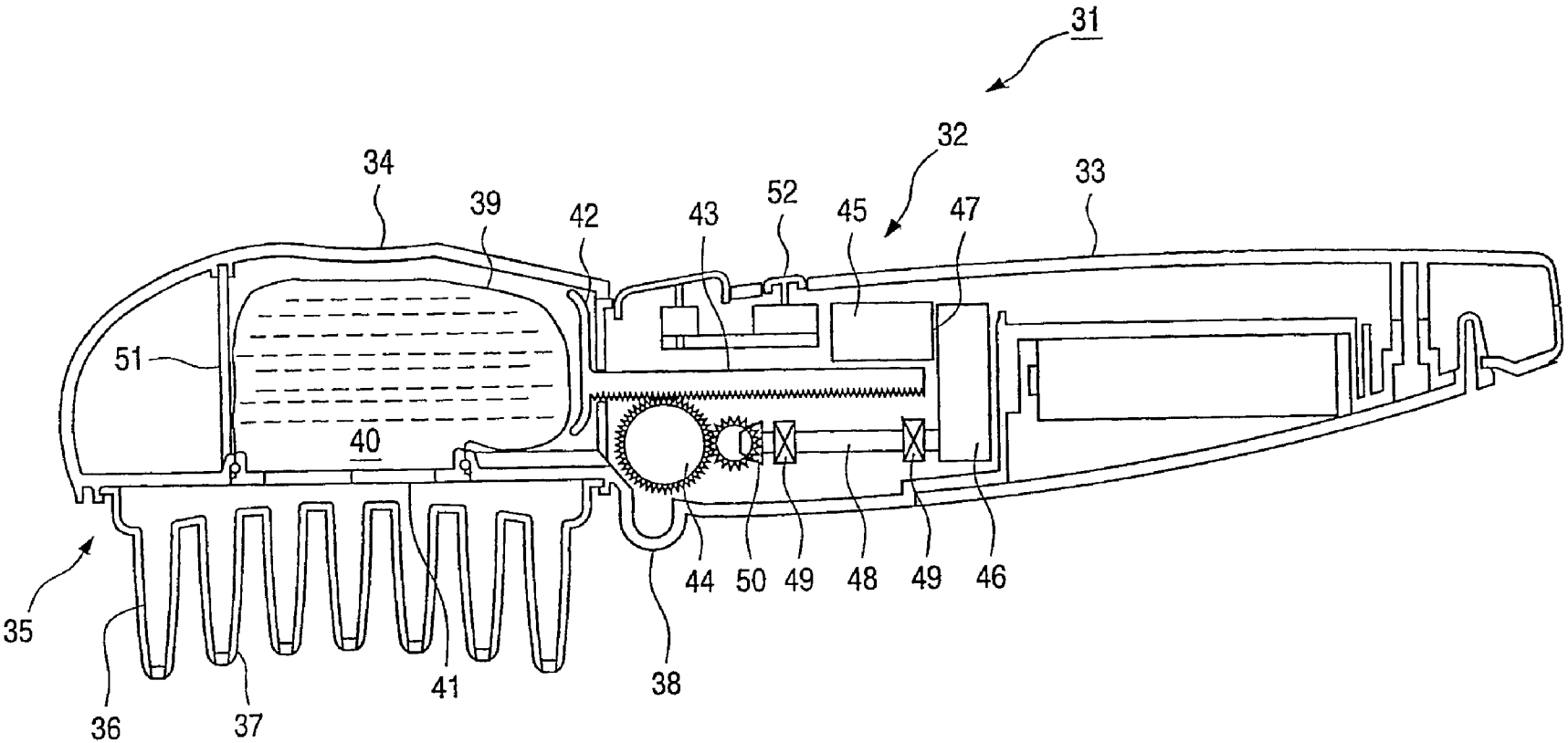
Figure 3:
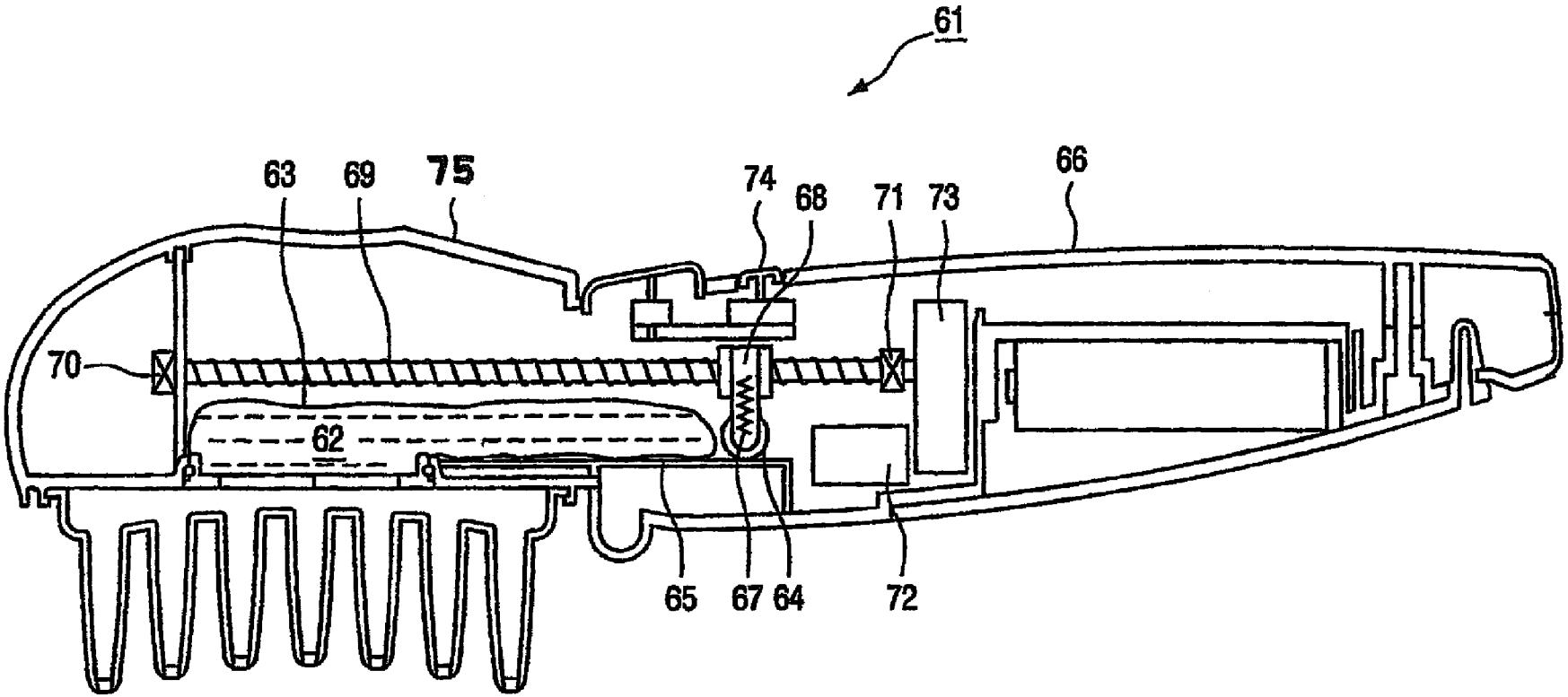

The invention and its features will be apparent from the following description of three preferred embodiments of the invention as illustrated in the accompanying diagranmmatic drawings, in which:

FIG. 1 is a cross-sectional view of a first preferred embodiment of a device according to the invention, FIG. 2 is a cross-sectional view of a second preferred embodiment of the device according to the invention, and FIG. 3 is a cross-sectional view of a third preferred embodiment of a device according to the invention.

FIG. 1 illustrates a hair dye applicator 1. This applicator 1 comprises a housing 2 mainly consisting of a gripping part 3 and a hair dye part 4. At the bottom of the hair dye part 4, a hollow comb body 5 is attached to the hair dye part 4. The comb body 5 comprises hollow pins 6 having outlet openings 7 near their free ends. The gripping part 3 and the hair dye part 4 are hinged together by a film hinge 8. In the closed position as illustrated in FIG. 1, the gripping part 3 and the hair dye part 4 are connected to each other in a location referenced 9 such that the inner volumes of gripping part 3 and hair dye part 4 are separated from each other airtight by a separation plate 10 which forms part of the gripping part 3. In the open position, in which the gripping part 3 has been rotated through 90 degrees, an opening 11 is created which allows the introduction of a flexible bag 12 filled with a hair dye fluid 13 into hair dye part 4. The flexible bag 12 may very suitably be made of thin-wall PE of 0.15 mm thick, although alternative materials may obviously be used, as will be clear to the person skilled in the art. The bag is provided with a one-way valve 14 having centrally a closable opening 15 which is opened as soon as enough pressure is exerted on this one-way valve 14 from the inside of bag 12 by fluid 13. The one-way valve is at a position outside the bag 12 provided with a circumferential groove with which it can be detachably gripped within an opening (Detail A) at the bottom of hair dye part 4 of the housing 2. This way the risk of contents getting spilled within the hair dye pair 4 is eliminated.

Within the gripping part 3, an electric motor 16 is provided which powers an air pump 17 which delivers air via a tube 18 into the airtight hair dye part 4. A switch 20 is present on the outside of gripping part 3 for the control of the motor 16, whereas batteries, for example two of the AA size dry cell type, can be accommodated within a space 21 of the gripping part 3 for the electrical power supply to motor 16.

An air valve 19 is present within the separating plate 10 at the end of tube 18. The one-way air valve 19 ensures that air will only flow into the hair dye part 4 and will not flow from the hair dye part via valve 19. Introducing air within the hair dye part 4 increases the air pressure within the hair dye part 4, causing an increased air pressure to act on flexible bag 12 and hair dye fluid 13. If sufficiently high, this pressure will cause the hair dye fluid 13 to pass through the opening in the bottom of flexible bag 12 and through opening 15 of one-way valve 14, after which the hair dye fluid 13 will be distributed over the pins 6 and leave the comb body through outlet openings 7 to reach the hair.

If for some reason, for example because the flexible bag 12 has been completely emptied, the pressure increases too much within the hair dye part 4, a vent button 22 will deform in such a way that air my leave the hair dye part 4. Applicator 31 illustrated in FIG. 2 has the same configuration as applicator 1 in FIG. 1 in certain respects. Again we have a housing 32 mainly consisting of a gripping part 33 and a hair dye part 34. At the bottom of the hair dye pail 34, a comb body 35 is attached having downwardly extending hollow pins 36 with outlet openings 37 at their lower ends. Rotation of the gripping part 33 about film hinge 38 opens the side of hair dye part 34 facing the gripping part 33, thus allowing the introduction of a flexible bag 39 containing hair dye fluid 40. In the introduced state, the flexible bag 39 lies on top of one-way valve 41.

A pressure plate 42 attached to the outer end of a toothed rack 43 is provided for exerting pressure on the flexible bag 39 and the forcing out of hair dye fluid 40 therefrom. This toothed rack 43 co-operates with a toothed wheel 44. A motor 45 is present within the gripping part 33 of applicator 1. In order to reduce the high rpm of the motor to the required rpm of toothed wheel 44, a gearbox 46 is mechanically coupled to the outgoing shaft 47 of motor 45. The rotational movement of the outgoing shaft 48 of gearbox 46, which has two bearings 49, is transmitted to the toothed wheel 44 by miter gear 50. A translatory movement of toothed rack 43 in the direction of flexible bag 39 will cause this flexible bag 39 to be pressed against pressure plate 51, which plate 51 is an integral part of hair dye part 34, so that hair dye fluid 40 will leave this flexible bag 39 through its opening and through the opening of one-way valve 41, after which it will distribute over the pins 36 of comb body 35 and finally leave this comb body 35 through outlets openings 37.

Applicator 61 as illustrated In FIG. 3 again has a comparable configuration as applicator 1 illustrated in FIG. 1. In order to avoid unnecessary repetitions of the description, only the part of this applicator 61 will be described which enables the forcing out of hair dye fluids 62 from flexible bag 63. In this device a roller drum 64 is used for rolling over the filled flexible bag 63, thus squeezing out its contents. The flexible bag 63 is placed upon a flat surface 65 which extends both through the gripping part 66 and through the hair dye part 75. The roller drum 64 is loaded by spring 67 which is operable between the roller drum 64 and a translation body 68 having an internal screwthread. This internal screwthread cooperates with a spindle screw 69 which is journaled at its outer ends by bearings 70,71. The rotational drive of the spindle screw 69 is provided by a motor 72 whose rotational speed is reduced by gearbox 73. Rotation of the spindle screw 69 causes the translation body 68 with the roller drum 64 to perform a transverse movement along the spindle screw. During this movement, the roller drum 64 rolls over the flexible bag 63, thus squeezing out its contents.

Although all above described embodiments are provided with a film hinge between a gripping part and a hair dye part, alternative embodiments are possible within the spirit of the invention. For example, instead of such a film hinge exposing the flexible bag, the hollow comb body could be constructed so as to be detachable from the hair dye part. The one-way valve such as, for example the one-way valve 14 of FIG. 1, together with the flexible bag 12, may then be pulled from the hair dye part, by simply releasing a snap fit. Other than the bags described above, such a flexible bag could then be detached from the one-way valve by pulling the two apart. Upon changing to a new bag or recharging with the old one (in the case of the same colorant being used after washing of the bag), the bag may be fitted with the one-way valve again in that the opening of the bag is slightly stretched so as to position itself into a groove at the outer circumference of the one-way valve. The bag is fully sealed by the one way valve; and upon placing back into the hair dye part, the one way valve is secured by the snap fit again. This way of exchanging a bag is suitable in particular for embodiments with a moving piston according to FIG. 2 or a roller drum according to FIG. 3.

In addition to the main switch of the main motor or combined with this switch, a switch 52 of FIG. 2 or 74 of FIG. 3 may be provided for returning the pressure plate 42 or the roller drum 64 to its initial position. Upon activation of this switch, the connection terminals of the electric motor 45, 72 are interchanged, which will cause the rotation of the outgoing axis to be reversed, thus bringing back the piston or roller drum to its initial position.

The invention claimed is:

1. A hair treatment fluid application device comprising;

an applicator body having outlet orifices for applying said hair treatment fluid to hair, a flexible container for containing said hair treatment fluid, said flexible container having a passage opening for allowing egress of said hair treatment fluid from said flexible container to said applicator body a housing for accommodating said flexible container, pressure means for exerting pressure on said flexible container for forcing said hair treatment fluid from said flexible container through said passage opening to said applicator body by deforming said flexible container, and driving means for driving said pressure means, wherein said pressure means comprises an air pump for increasing air pressure within at least part of said housing.

2. A device as claimed in claim 1, wherein said pressure means are located within said housing.

3. A device as claimed in claim 1, wherein said passage opening is embodied by a one-way valve member.

4. A device as claimed in claim 1, wherein said housing is provided with a one-way valve member for hair treatment fluid which has issued through said passage opening to the exterior.

5. The device of claim 1, wherein the driving means comprises an electric motor for driving the air pump.

6. The device of claim 5, further comprising a switch external to the housing for selectively supplying electric power to the electric motor.

7. The device of claim 5, wherein said electric power is supplied by a battery disposed with the housing.

8. The device of claim 1, wherein the housing comprises a first part for holding the flexible container, and a second part for gripping the device, the first and second parts being separated form each other by a separating plate.

9. The device of claim 8, wherein the air pump is disposed in the second part of the housing and the air pump increases the pressure within the first part of the housing.

10. The device of claim 9, further comprising a one-way air valve between the first and second parts of the housing, wherein the air pump supplies air to first part of the housing through the one way air valve.

11. The device of claim 8, further comprising a rotatable hinge connecting the first part of the housing to the second part of the housing.

12. The device of claim 8, further comprising a one-way air valve between the first and second parts of the housing, wherein the air pump supplies air to first part of the housing through the one way air valve.

13. The device of claim 1, wherein the housing comprises:

a first part defining a first cavity for enclosing the flexible container therein; and a second part defining a second cavity for enclosing the air pump and driving means therein, the first and second cavities being separated from each other by a separating plate.

14. The device of claim 13, further comprising a one-way air valve between the first and second parts of the housing, wherein the air pump supplies air to the first part of the housing through the one way air valve.

15. A hair treatment fluid application device comprising a flexible container for containing said hair treatment fluid, an applicator body having outlet orifices for applying said hair treatment fluid to hair, said flexible container having a passage opening for allowing egress of said hair treatment fluid from said flexible container to said applicator body and a housing for accommodating said flexible container, characterized by pressure means for exerting pressure on said flexible container for forcing said hair treatment fluid from said flexible container through said passage opening to said applicator body by deforming said flexible container, and by driving means for driving said pressure means, and characterized in that said part of said housing is provided with air release means for releasing air from said housing as soon as the air pressure within said part of said housing exceeds a certain threshold value.

* * * * *